US008911529B2

(12) United States Patent
Withers et al.

(10) Patent No.: US 8,911,529 B2
(45) Date of Patent: Dec. 16, 2014

(54) LOW COST PROCESSING TO PRODUCE SPHERICAL TITANIUM AND TITANIUM ALLOY POWDER

(75) Inventors: James C. Withers, Tucson, AZ (US); Raouf O. Loutfy, Tucson, AZ (US)

(73) Assignee: Materials & Electrochemical Research Corp., Tucson, AZ (US)

( * ) Notice: Subject to any disclaimer, the term of this patent is extended or adjusted under 35 U.S.C. 154(b) by 414 days.

(21) Appl. No.: 13/447,022

(22) Filed: Apr. 13, 2012

(65) Prior Publication Data

US 2012/0272788 A1 Nov. 1, 2012

Related U.S. Application Data

(60) Provisional application No. 61/517,871, filed on Apr. 27, 2011.

(51) Int. Cl.

| | |
|---|---|
| ***B22F 9/08*** | (2006.01) |
| ***C22C 14/00*** | (2006.01) |
| ***B22F 9/24*** | (2006.01) |
| ***C22C 1/04*** | (2006.01) |
| ***B22F 1/00*** | (2006.01) |

(52) U.S. Cl.

CPC ..... *C22C 14/00* (2013.01); *B22F 9/082* (2013.01); *B22F 9/24* (2013.01); *C22C 1/0458* (2013.01); *B22F 1/0048* (2013.01); *B22F 2009/0848* (2013.01); *B22F 2202/01* (2013.01); *B22F 2998/10* (2013.01); *B22F 2999/00* (2013.01)

USPC ..... 75/335; 75/338; 75/346; 75/354

(58) Field of Classification Search

None

See application file for complete search history.

(56) References Cited

U.S. PATENT DOCUMENTS

| | | | | |
|---|---|---|---|---|
| 4,544,404 | A | 10/1985 | Yolton et al. | 75/0.5 C |
| 4,576,642 | A * | 3/1986 | Holtz, Jr. | 75/239 |
| 4,602,947 | A | 7/1986 | McClincy et al. | 75/0.5 BB |
| 4,639,281 | A | 1/1987 | Sastry et al. | 148/407 |
| 4,731,111 | A * | 3/1988 | Kopatz et al. | 75/342 |
| 4,999,051 | A | 3/1991 | Yolton et al. | 75/338 |
| 5,147,448 | A | 9/1992 | Roberts et al. | 75/331 |
| 5,176,810 | A * | 1/1993 | Volotinen et al. | 205/397 |
| 5,213,610 | A | 5/1993 | Yolton et al. | 75/351 |
| 5,332,197 | A | 7/1994 | Benz et al. | 266/201 |
| 6,425,504 | B1 | 7/2002 | Besser et al. | 222/593 |
| 6,939,389 | B2 * | 9/2005 | Mooney et al. | 75/346 |
| 7,297,271 | B2 | 11/2007 | Onishi et al. | 210/510.1 |
| 7,410,562 | B2 | 8/2008 | Withers et al. | 205/367 |
| 7,682,556 | B2 | 3/2010 | Han et al. | 266/218 |
| 7,794,580 | B2 | 9/2010 | Withers et al. | 205/560 |
| 7,914,600 | B2 | 3/2011 | Withers et al. | 75/366 |
| 2004/0123700 | A1 | 7/2004 | Zhou et al. | 75/366 |
| 2005/0166706 | A1 | 8/2005 | Withers et al. | 75/10.23 |
| 2006/0185473 | A1 | 8/2006 | Withers et al. | 75/10.13 |
| 2007/0062332 | A1 | 3/2007 | Jones et al. | 75/338 |
| 2008/0190778 | A1 | 8/2008 | Withers et al. | 205/557 |
| 2009/0272228 | A1 | 11/2009 | Forbes Jones et al. | 75/331 |

OTHER PUBLICATIONS

PCT International Preliminary Report on Patentability issued in corresponding application No. PCT/US2012/033652, dated Nov. 7, 2013 (8 pgs).

International Search Report and the Written Opinion, dated Aug. 10, 2012 (11 pgs).

* cited by examiner

*Primary Examiner* — George Wyszomierski

(74) *Attorney, Agent, or Firm* — Hayes Soloway P.C.

(57) ABSTRACT

Low cost spherical titanium and titanium powder alloy powder is produced by impinging a stream of an inert gas, such as argon, on the surface of a molten pool of titanium or sponge and alloying elements.

27 Claims, 6 Drawing Sheets

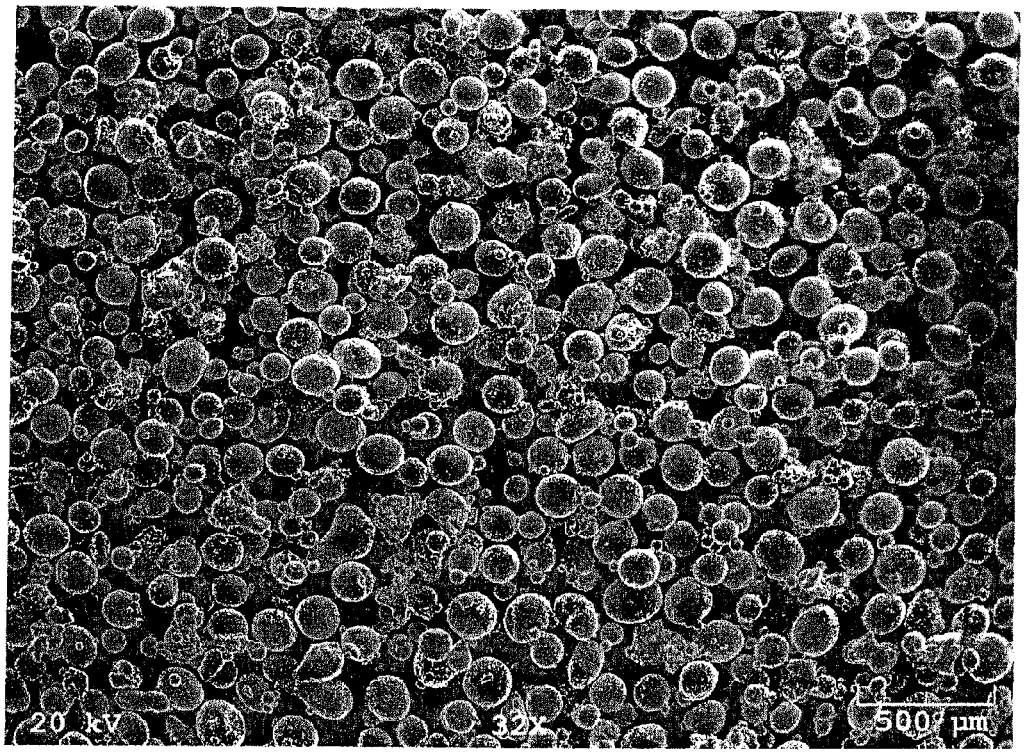
Figure 4: Spherical titanium allow (Ti-6Al-4VP powder.

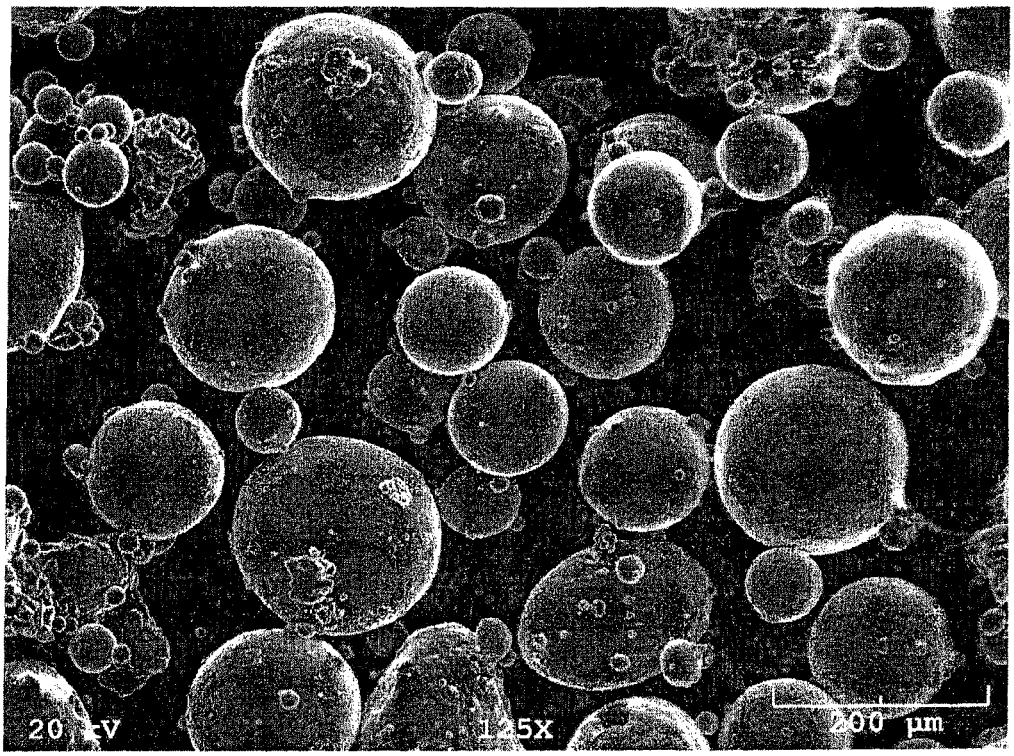
Figure 5: Spherical titanium Powder Ti-6Al-4V

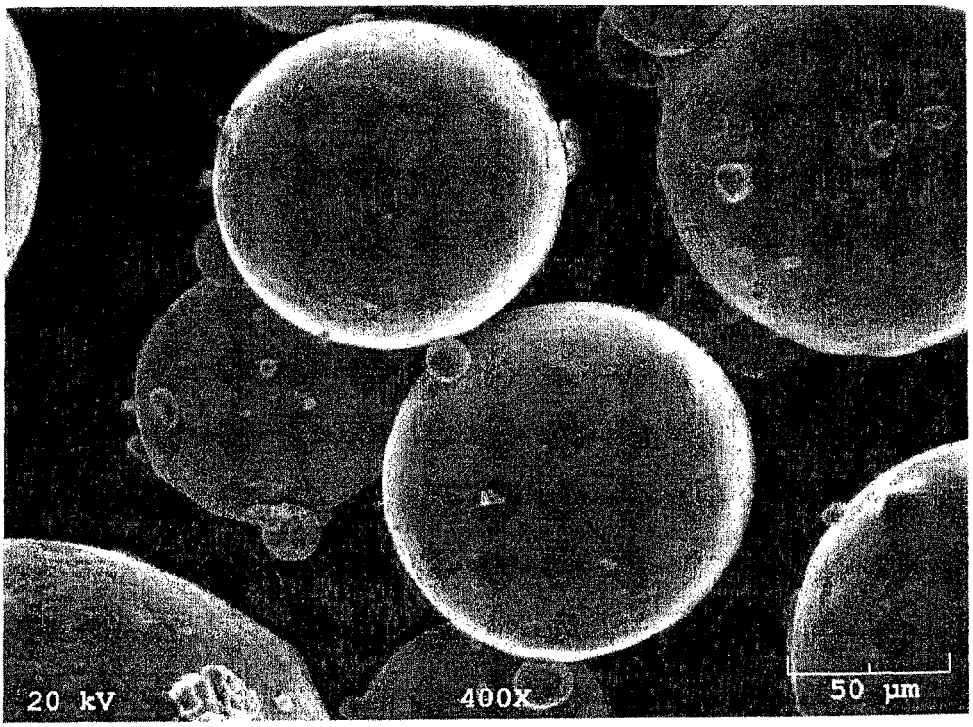
Figure 6: Spherical Titanium Powder Ti-6Al-4V

LOW COST PROCESSING TO PRODUCE SPHERICAL TITANIUM AND TITANIUM ALLOY POWDER

CROSS REFERENCE TO RELATED APPLICATION

This application claims priority from U.S. Provisional Application Ser. No. 61/517,871, filed Apr. 27, 2011, the contents of which are incorporated herein by reference.

BACKGROUND OF THE INVENTION

Metal powders provide a diversity of applications to produce components. Notably powdered metals are utilized in sintering approaches as well as feeds in melt approaches of near to net shape rapid manufacturing. Ideally metal powders are in a spherical morphology that provides good flowability and packing density. Steel and many other metal powders are widely utilized to produce low cost components. It has long been sought to utilize titanium alloy powders to produce components which has not been widely utilized primarily because of the high cost of titanium powder. During the period 2010 and into 2011 the cost of spherical titanium powder has been in the $150/lb cost range. At these high costs only the most cost insensitive applications utilize spherical titanium powder to produce component products has been pursued.

The high cost of spherical titanium powder in large part is due to the high cost of conventional processing to produce alloyed titanium ingot from sponge that is then used to melt produce spherical titanium powder by one of several approaches. State-of-the-art titanium processing is in very large scale and batch segregated operations. Typically, Kroll sponge processing is carried out in large retorts producing approximately ten ton batches over many days of operation of adding $TiCl_4$ to the molten magnesium in the retort and draining resulting molten $MgCl_2$ from the retort followed by a week or more vacuum evaporation to remove the residual entrapped $MgCl_2$ and unreacted Mg. The vacuum purified sponge is then melted in very large skull type furnaces with the heat supplied by electron beams or plasmas. Alloying elements may then be added to the large ton size melts to produce desired alloy compositions such as Ti-6Al-4V which is then cast into ingots. Often triple melting is performed to attain uniform alloying. As a result, titanium ingot prices are quite cyclic that also influence the high cost of spherical titanium powder.

SUMMARY OF THE INVENTION

The present invention provides processes for producing low cost spherical titanium powder. In one aspect of the invention titanium sponge is conveyed to a plasma heating system into which is also conveyed a pre-alloy powder of desired alloying metals, e.g., aluminum and vanadium, or separately conveyed aluminum and vanadium powder may be separately conveyed to a plasma station where they are melted by the plasma to produce a pool or stream of molten uniform alloy of, e.g., Ti-6Al-4V in a continuous manner. The molten alloy composition is dispersed by impinging a stream of inert gas across the surface of the pool or through the stream under controlled conditions, to blast droplets of the molten alloy which upon cooling produce spherical titanium alloy powder, e.g., Ti-6Al-4V. The cost savings are significant. While the cost of titanium sponge is cyclic, its price in the 2010-2011 period was in the range of $3 to $10/lb and typically in the $4-$6/lb range. The cost to operate a plasma to melt the titanium alloy in a controlled pool size and generate spherical powder is in the range of approximately $1-$2/lb which provides a basis to produce spherical Ti-6Al-4V powder from a typical sponge source in the range of $10-$15/lb, which represents a significant saving over conventionally produced spherical titanium powder which, as noted supra, is in the $150/lb cost range.

In another aspect of the invention electrolytically produced titanium is conveyed to a plasma heated evaporator under inert atmospheric or under vacuum heated to 800-1600° C. which rapidly evaporates the fused salt electrolyte that is returned to the electrolytic cell, and the remaining titanium is conveyed to a plasma heating station that supplies additional heat to melt and alloy the titanium analogous to the above discussed sponge feed with uniform spherical alloy powder being produced from the plasma heating station by dispensing the melt by impinging a stream of inert gas on the melt under controlled conditions to blast droplets of the molten alloy which upon cooling produce spherical powder of titanium alloy. Again, the cost savings are significant. Electrolytic titanium can be produced for an estimated cost of approximately $1.50-$2.50/lb which provides a basis for producing uniform spherical titanium alloy powder for under $10/lb. The heat source for raising the salt-electrolytic titanium stream from approximately 500° C. to over 900° C. to rapidly and flash evaporate the salt can be conventional resistance, radiation, induction, microwave or plasma. Plasma heating typically is utilized for spherizing the liquid titanium into spherical powder.

Unlike a conventional Kroll process, the processes of the instant invention may be performed on a continuous basis with small segmental heating. As an example, in the case of flash evaporation of the residual electrolytic salt titanium powder or sponge with $MgCl_2$ and Mg, the quantity that is instantaneously heated is in the range of 10 g to 100 Kg and preferably in the range of 100 g to 10 Kg which is similar to the quantity of titanium that is being plasma melted and alloyed. Uniformity of alloying is achieved instantaneously in the small melt pools of the instant invention.

In a traditional state-of-the-art Kroll process to make sponge, vacuum evaporate, melt and alloy, and cast into an ingot at least 20 days are consumed to process a ten ton batch which translates to approximately 1,000 lbs/day (454 Kg/day). For making alloy powder further time is consumed that further reduces unit rate of powder production. In the instant invention the residual time in flash salt evaporation and plasma melting is quite quick, i.e. as little as one minute and typically no more than 10 minutes depending on the heat content or heat flux of the supplied heat of the plasma or other heating means. Even at a slower heating rate of, e.g., 10 minutes, and a small content of material of e.g., at one Kg, sixty Kg would be processed in an hour and 1440 Kg per day which is well in excess of a mature large batch state-of-the-art Kroll based processing. In a production operation of the instant invention, throughput would more likely be 10 Kg processed in three minutes, thus producing 4,800 Kg per day providing advantageous volume of scale and economics.

BRIEF DESCRIPTION OF THE DRAWINGS

Further features and advantages of the present invention, will be seen from the following detailed description and working examples, taken in conjunction with the accompanying drawings, wherein:

FIG. 4 is a scanning electron microscope photograph of spherical titanium alloy powder made in accordance with one embodiment of present invention;

FIG. 5 is a scanning electron microscope photograph of spherical titanium alloy powder made in accordance with another embodiment of the present invention; and FIG. 6 is a scanning electron microscope photograph of spherical titanium alloy powder made in accordance with a third embodiment of the present invention.

DETAILED DESCRIPTION OF PREFERRED EMBODIMENTS

Figure 1:
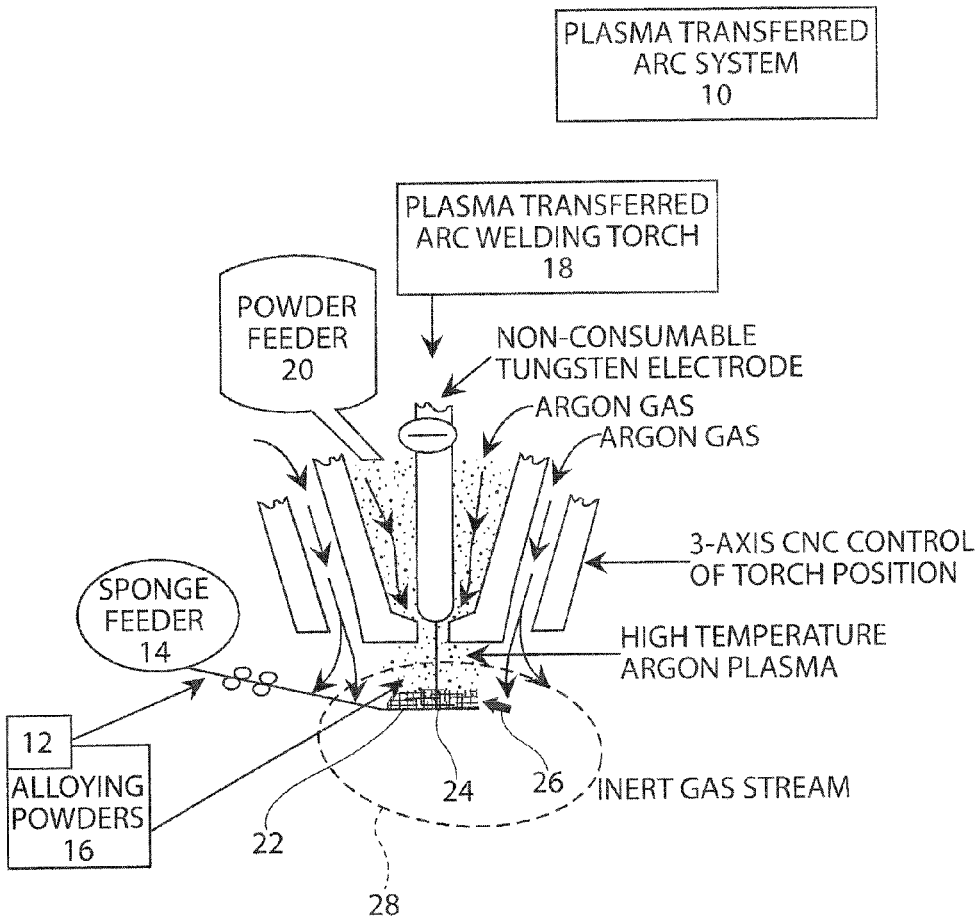
FIG. 1 is a schematic diagram and FIG. 1*a* is an enlarged view illustrating a process for producing spherical titanium powder in accordance with a first embodiment of the present invention.
Figure 1A:
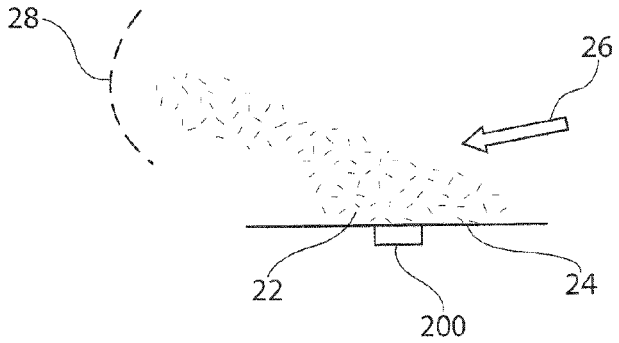

Referring to FIGS. 1 and 1*a*, in a first embodiment of the present invention, titanium sponge 14 is conveyed to a plasma transferred arc (PTA) welding torch of the type 10 shown in FIG. 1 of U.S. Application No. 2006/0185473-A1, the contents of which are incorporated herein by reference. A pre-alloyed powder of aluminum-vanadium or a mixture of the elemental alloying elements was added to the plasma torch from a powder feeder 20 at a controlled rate to produce an alloy of Ti-6Al-4V. A molten pool 22 of alloy Ti-6Al-4V approximately one-half inch in diameter by one-eighth inch to one-quarter inch deep is formed on a target substrate 24.

A stream of inert gas, e.g. argon, was continuously blown from a nozzle 26 to impinge on the surface of the molten pool at 22, to blast droplets of molten alloy from the pool, which, upon cooling, solidify into spherical alloy particles. Flow of the inert gas from nozzle 26 should be controlled to impinge on the surface of the molten pool at an angle of 45 to 180 degrees, and at a velocity of 10 to 1000 liters/min, to blast the molten alloy from the pool at the same rate as the pool is being formed. The molten alloy is blown from the surface of the pool as fine droplets of essentially uniform size which cool almost instantaneously to form essentially uniform size particles of alloy which are deflected at particle collection baffle 28 and collected by gravity.

Optionally, the target substrate 24 may be vibrated, e.g. by an ultrasonic horn or piezoelectric vibrator 200 (FIG. 1*a*), to assist in lifting and dislodging of particles from the molten pool.

Alternatively, instead of initially collecting PTA produced molten alloy at substrate 24, the molten titanium alloy stream from the PTA may be hit with a stream of argon gas to break the stream of titanium alloy particles into smaller particles which are then quenched into spherical powder in liquid argon.

Figure 2:
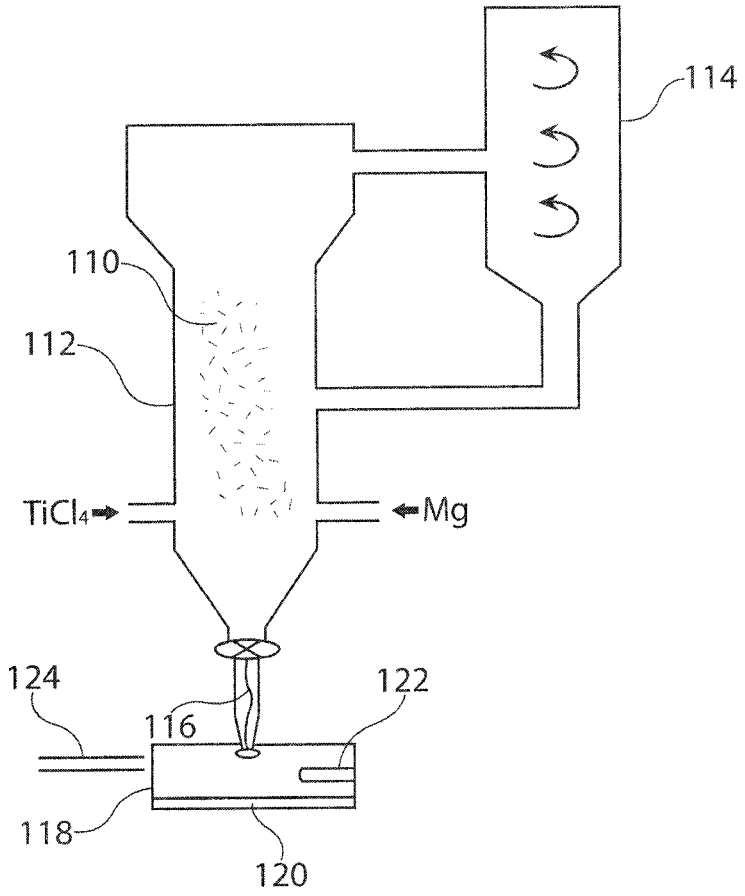
FIG. 2 is a schematic diagram illustrating a process for forming spherical alloy titanium particles in accordance with a second embodiment of the present invention.

Referring to FIG. 2, in accordance with another embodiment of the invention, $TiCl_4$ and Mg vapors are introduced into the reaction zone 110 of a fluid-bed reactor 112 where they can react by homogenous nucleation to produce small particles, typically under one micron, which are collected in a series of cyclones 114 designed to collect such small particles at the velocity of the reactor gas flow. The small particles are recycled into the fluid-bed reactor reaction zone 110 where they are built up through additional deposition from $TiCl_4$ and Mg vapor reaction. Recycle is continued until the particles grow to a desirable size range of for example, 40 microns to 300 microns. As the particles become larger, they become heavier and settle to the bottom of the reactor, where they can be extracted by gravity flow through a pipe 116 connected to the bottom of the fluid reactor, i.e., as described in my earlier U.S. Pat. No. 7,914,600 the contents of which are incorporated herein by reference.

The extracted particles then were streamed to a shallow heated tank 118 to form a molten pool 120 of alloy. A stream of argon 122 was blown through the stream, or over the surface of the molten pool to blast particles of titanium alloy, as before, which were withdrawn from the tank 118 via conduit 124.

Figure 3:
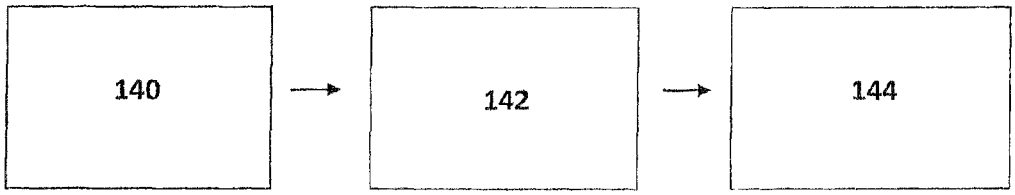
FIG. 3 is a schematic diagram illustrating a process for forming spherical alloy titanium particles in accordance with a third embodiments of the present invention.

Referring to FIG. 3, in accordance with yet another embodiment of the invention, a titanium powder is produced by magnesium reduction of $TiCl_4$ as described in my co-pending application Ser. No. 12/016,859, the contents of which are incorporated herein by reference, in an electrolyte cell according to FIG. 2 of my aforesaid '859 application, at block 140. A slurry stream of $MgCl_2$ containing titanium powder was produced, and was conveyed into a salt evaporation system 142 where the residual salt was evaporated by heating. Heating may be accomplished by resistance, induction, radiation, microwave or plasma under an inert atmosphere, which, if desired, may be at reduced pressure to aid evaporation. After the $MgCl_2$ salt evaporation, the resulting titanium powder, along with alloying metal powder was conveyed into a PTA melting system similar to that shown on FIG. 1, and illustrated generally at block 144, where substantially uniform spherical alloy powder was produced by blasting droplets of molten alloy from the molten stream of alloy from the PTA, or collect up in a pool on the substrate, as before, and cooling and collecting solidified powder, as before.

The present invention will be further described in connection with the following non-limiting working examples:

EXAMPLE 1

Cleaned evaporated titanium sponge was conveyed to a plasma transferred arc (PTA) heat source controlled by CNC type processes as described in U.S. Published Application 2006/0185473-A1, into which was co-conveyed a pre-alloyed powder of aluminum-vanadium at controlled rates to produce a melt pool of an alloy of Ti-6Al-4V. The melt pool was approximately one-half inch in diameter by one-eighth to one-quarter inch deep. A stream of argon was continuously blown across the molten pool that whereby to produce spherical powder such as shown in the SEM photographs of FIG. 4. The conveying of feeds and melting with the PTA was performed continuously as was the argon stream that blew spherical particles thus continuously producing spherical alloy particles.

EXAMPLE 2

The process of Example 1 was repeated except the molten PTA produced melt pool was collected on a target having an orifice through which the molten titanium alloy dropped surrounded with a stream of argon gas. The molten alloy stream was broken into particles by the stream of argon gas, and the particles were quenched into spherical powder in liquid argon in the bottom of a powder catch container. The produced titanium powder is shown in FIG. 5.

EXAMPLE 3

Electrolytic titanium powder was produced by processing according to U.S. Pat. Nos. 7,914,600, 7,410,562, and 7,794, 580 or alternately by feeding titanium tetrachloride ($TiCl_4$) to a salt electrolyte containing KCl—LiCl. The titanium powder was produced in a continuous configured electrolytic system with an output pumped stream at approximately 500° C. containing approximately 15% titanium powder and 75% liquid salt. The electrolytic titanium powder-salt stream was pump conveyed to a shallow tank heated by induction to approximately 1000° C. The tank had a slight vacuum of approximately 10 Torr which cleanly evaporated the KCl—LiCl salt in approximately three minutes. The residual electrolytic titanium powder was conveyed along with aluminum and vanadium powder in a ratio to produce Ti-6Al-4V alloy in a plasma melt of blended titanium and Al—V powder against which was blown argon that produced spherical titanium alloy powder of Ti-6Al-4V as shown in FIG. 6.

EXAMPLE 4

A standard Kroll reaction was run that produced titanium sponge. After draining the by-product $MgCl_2$ of residual unreacted Mg, the sponge with the residual $MgCl_2$ and Mg was conveyed directly into the plasma system described in Example 3 without pre-evaporating the residual $MgCl_2$ and Mg. The plasma melted the titanium and evaporated the $MgCl_2$ and Mg. Argon gas was blown through the plasma electrodes onto the surface of the melt, blasting droplets of liquid titanium, which were cooled and produced spherical titanium particles, which were collected as before.

EXAMPLE 5

The process of Example 4 was repeated, except Al—V alloy or as separate powders were conveyed with the titanium sponge containing residual $MgCl_2$ and Mg, resulting in a titanium alloy powder being produced.

EXAMPLE 6

Titanium powder was produced using magnesium reduction of $TiCl_4$ as described in my co-pending application Ser. No. 12/016,859 which produced a stream of $MgCl_2$ at approximately 800° C. containing approximately 20% titanium powder. A slurry stream was conveyed into the salt evaporation system described in Example 3. After the $MgCl_2$ salt evaporation, the titanium powder along with chromium and molybdenum powder was conveyed into the PTA melting system as described in Examples 1 and 2 and spherical alloy powder by the Example 2 processing was produced consisting of Ti-5Cr-2Mo. In similar manner particles of Ti-8Al-1Mo-1V alloy may be produced.

It is understood any titanium alloy composition can be produced in spherical alloy powder or alternatively as an ingot with the addition of alloying elements co-conveyed with the titanium powder to the plasma melter. It also is understood particulate that reacts or remains unreacted with the molten titanium can be added to be incorporated in the spherical titanium alloy powder. A reactive powder example is titanium diboride that reacts to provide titanium boride on cooling, aluminum nitride to give titanium nitride and $Al_3Ti$ on cooling, or boron carbide to give titanium boride plus titanium carbide on cooling. Non-limiting examples of particles more stable than titanium include hafnium oxide or calcium oxide. Also, inert gases other than argon advantageously may be employed.

The above descriptions, embodiments and examples are given to illustrate the scope and spirit of the instant invention. It is obvious that many changes may be made in the embodiments and arrangements described in the scope, it is not intended to be strictly limited thereof, and other modifications and variations may be employed within the scope of the instant invention and the following claims.

The invention claimed is:

1. A process for producing spherical titanium alloy powder comprising combining a molten pool or stream of titanium sponge and alloying elements to form a molten pool or stream of titanium alloy, impinging a stream of an inert gas across the surface of the molten pool or through the stream of titanium alloy melt whereby to dislodge droplet particles of titanium alloy from the molten pool or stream, and cooling and solidifying the dislodged droplet particles to form spherical titanium alloy powder.

2. The process of claim 1 wherein the molten pool or stream is formed in a plasma heating system.

3. The process of claim 2, wherein the alloy is Ti-6Al-4V.

4. The process of claim 2, wherein the alloy is Ti-8Al-1Mo-1V.

5. The process of claim 1, wherein the alloying elements comprise aluminum and vanadium.

6. The process of claim 5, wherein the alloying elements are pre-alloyed.

7. The process of claim 1, wherein the inert gas comprises argon.

8. The process of claim 1, wherein the molten pool is vibrated.

9. The process of claim 1, wherein a melt is formed from an ingot comprising titanium sponge and the alloying elements.

10. The process of claim 1, wherein the stream of inert gas is continuously impinged across the surface of the molten pool or stream of titanium alloy melt.

11. A process for producing titanium alloy powders comprising forming a molten pool or stream of electrolytically-produced titanium powder containing residual salt, evaporating the salt, conveying the resulting titanium powder, minus the salt, to a plasma heating system together with alloying elements to form a molten pool or stream of titanium alloy, impinging a stream of inert gas across the surface of the molten pool or stream of titanium alloy to dislodge droplet particles of titanium from the melt, and cooling and solidifying the dislodged droplet particles to form spherical titanium alloy powder.

12. The process of claim 11, wherein the residual salt is evaporated by heating in an inert atmosphere under reduced pressure.

13. The process of claim 11, wherein the inert gas comprises argon.

14. The process of claim 11, wherein the molten pool is vibrated.

15. A process for producing spherical titanium alloy particles, which comprises co-melting titanium sponge containing residual magnesium chloride and magnesium metal with alloying elements in a plasma melter, evaporating the magnesium chloride and magnesium to form a pool or stream of titanium alloy melt, and impinging a stream of an inert gas across the surface of the titanium alloy melt or through the stream of titanium alloy melt to dislodge droplet particles of titanium alloy, and cooling the dislodged droplet particles to produce spherical alloy titanium powder particles.

16. The process of claim 15, wherein the inert gas comprises argon.

17. The process of claim 15, wherein the droplet particles are formed by passing the alloy melt through an orifice surrounded by a flow of inert gas.

18. The process of claim 17, including the step of collecting the droplet particles in a pool of liquid argon.

19. The process of claim 15, wherein the pool is vibrated.

20. The process of claim 15, wherein the alloy is Ti-6Al-4V.

21. The process of claim 15, wherein the alloy is Ti-8Al-1Mo-1V.

22. The process of claim 15, wherein the stream of inert gas is continuously impinged across the surface of the pool or stream of titanium alloy melt.

23. A process for producing spherical titanium alloy particles, comprising electrolytically producing titanium powder in a stream of a salt electrolyte at or above an operating temperature of 500° C. in an electrolytic cell, conveying the titanium powder into an induction heated evaporator operated at or above 900° C. and under reduced pressure to evaporate the salt electrolyte, returning the salt electrolyte to the electrolytic cell, conveying the resulting titanium powder to a plasma melter along with alloying elements to produce a molten pool or stream of melted alloy, impinging a stream of inert gas on the molten pool or through the stream of melted alloy to dislodge droplet particles, and cooling and solidifying the dislodged droplet particles to produce spherical titanium alloy powder.

24. The process of claim 23, wherein the pool is vibrated.

25. The process of claim 23, wherein the alloy is Ti-6Al-4V.

26. The process of claim 23, wherein the alloy is Ti-8Al-1Mo-1V.

27. The process of claim 23, wherein the stream of inert gas is continuously impinged across the surface of the molten pool or stream of melted alloy.

* * * * *